US009912125B2

(12) United States Patent
Yoshida et al.

(10) Patent No.: US 9,912,125 B2
(45) Date of Patent: Mar. 6, 2018

(54) SPARK PLUG

(71) Applicant: NGK SPARK PLUG CO., LTD., Nagoya-shi, Aichi (JP)

(72) Inventors: Haruki Yoshida, Tajimi (JP); Jumpei Isasa, Nishikasugai-gun (JP); Toshitaka Honda, Nagoya (JP); Yutaka Yokoyama, Kasugai (JP); Kuniharu Tanaka, Komaki (JP); Nobuyoshi Araki, Nagoya (JP); Toshiki Kon, Komaki (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/272,561

(22) Filed: Sep. 22, 2016

(65) Prior Publication Data

US 2017/0093133 A1 Mar. 30, 2017

(30) Foreign Application Priority Data

Sep. 24, 2015 (JP) ..... 2015-186376

(51) Int. Cl.
*H01T 13/38* (2006.01)
*H01T 13/18* (2006.01)
(Continued)

(52) U.S. Cl.
CPC ..... *H01T 13/38* (2013.01); *H01T 13/18* (2013.01); *H01T 13/60* (2013.01); *H01T 21/02* (2013.01)

(58) Field of Classification Search
CPC ..... H01T 13/38
(Continued)

(56) References Cited

U.S. PATENT DOCUMENTS

2001/0004184 A1 6/2001 Ito et al.
2005/0110382 A1 5/2005 Walker, Jr.
(Continued)

FOREIGN PATENT DOCUMENTS

EP 2 482 396 A1 8/2012
JP S63-190753 A 8/1988
(Continued)

OTHER PUBLICATIONS

European Patent Office, Extended European Search Report issued in corresponding Application No. 16190401.6, dated Feb. 17, 2017.
(Continued)

*Primary Examiner* — Christopher Raabe
(74) *Attorney, Agent, or Firm* — Stites & Harbison, PLLC; Jeffrey A. Haeberlin; James R. Hayne

(57) ABSTRACT

A spark plug includes an insulator, a center electrode, a metallic shell, and a ground electrode. The insulator contains not less than 90.0 mass % and not greater than 98.1 mass % of $Al_2O_3$ with respect to a total mass of elements, as reduced to oxides, contained in the insulator, and has a porosity not greater than 5%. Assuming that a porosity of the insulator after a heat treatment is B, a difference (B−A) of the porosities before and after the heat treatment is not greater than 3.5%. In the heat treatment, the insulator is placed in a furnace, and a temperature in the furnace is increased from a room temperature to 1400° C. at a temperature increase rate of 7° C./min and is held at 1400° C. for 30 minutes, and thereafter, the temperature is decreased from 1400° C. to 400° C. at a temperature decrease rate of 10° C. or less per 5 minutes and is decreased to the room temperature.

7 Claims, 2 Drawing Sheets

(51) Int. Cl.
*H01T 13/60* (2011.01)
*H01T 21/02* (2006.01)

(58) Field of Classification Search
USPC ..... 313/118
See application file for complete search history.

(56) References Cited

U.S. PATENT DOCUMENTS

2008/0042539 A1* 2/2008 Walker ..... H01T 13/38 313/135
2010/0136867 A1 6/2010 Kurono et al.
2011/0077141 A1* 3/2011 Walker ..... C04B 35/111 501/32
2011/0169396 A1* 7/2011 Drazenovic ..... C04B 35/117 313/141
2012/0176022 A1 7/2012 Nakagawa et al.
2012/0262049 A1 10/2012 Kurono et al.
2013/0175922 A1* 7/2013 Yoshida ..... H01T 13/20 315/58
2014/0243184 A1 8/2014 Fujimura et al.

FOREIGN PATENT DOCUMENTS

JP 2001-155546 A 6/2001
JP 2011-070928 A 10/2012
JP 2011-070929 A 10/2012
JP 2013-529355 A 7/2013
JP 2004-187004 A 10/2014
WO 2009/119098 A1 10/2009

OTHER PUBLICATIONS

Japan Patent Office, Notification of Reasons for Refusal issued in corresponding Application No. 2015-186376, dated Dec. 5, 2017.

* cited by examiner

SPARK PLUG

CROSS REFERENCE TO RELATED APPLICATION

The present application claims priority to Japanese Patent Application No. 2015-186376, which was filed on Sep. 24, 2015, the disclosure of which is incorporated herein by reference in its entirety.

BACKGROUND OF THE INVENTION

Field of the Invention

The present invention relates to spark plugs. In particular, the present invention relates to a spark plug including an insulator capable of maintaining withstand voltage performance under a high temperature environment.

Description of Related Art

Spark plugs for use in internal combustion engines such as automobile engines each have a spark plug insulator (also referred to simply as "insulator") formed from, for example, an alumina-based sintered material containing alumina ($Al_2O_3$) as a principal component. This insulator is formed from such an alumina-based sintered material because the alumina-based sintered material is excellent in heat resistance, mechanical strength, and the like. In order to obtain such an alumina-based sintered material, for example, a three-component sintering aid composed of, for example, silicon oxide ($SiO_2$), calcium monoxide (CaO), and magnesium monoxide (MgO) has been used for the purpose of lowering the firing temperature and improving sinterability.

The temperature in a combustion chamber of an internal combustion engine to which such a spark plug is attached sometimes reaches about 700° C., for example. Therefore, the spark plug is required to exert excellent withstand voltage performance in a temperature range from the room temperature to about 700° C. Alumina-based sintered materials have been proposed which are suitably used for insulators or the like of spark plugs exerting the withstand voltage performance.

For example, Patent Document 1 discloses " . . . an insulator for a spark plug, which comprises an alumina-based sintered body comprising: $Al_2O_3$(alumina) as a main component; and at least one component (hereinafter referred to as "E. component") selected from the group consisting of Ca (calcium) component, Sr (strontium) component and Ba (barium) component, wherein at least part of the alumina-based sintered body comprises particles comprising a compound comprising the E. component and Al (aluminum) component, the compound having a molar ratio of the Al component to the E. component of 4.5 to 6.7 as calculated in terms of oxides thereof, and has a relative density of 90% or more." (see claim 1 of Patent Document 1). Patent Document 1 indicates that this technique can provide a spark plug having an insulator which is less liable to occurrence of dielectric breakdown due to the effect of residual pores or low-melting glass phases present on boundaries of the alumina-based sintered body, and exhibits a higher dielectric strength at a temperature as high as around 700° C. than the conventional materials (see, for example, paragraph [0007] of Patent Document 1).

Meanwhile, Patent Document 2, for the purpose of providing a spark plug having an insulator that exerts high withstand voltage characteristics and high-temperature strength (see paragraph [0014] of Patent Document 2), discloses "A spark plug . . . the insulator is formed from a dense alumina-based sintered material having a mean crystal grain size $D_A$(Al) of 1.50 μm or more; the alumina-based sintered material contains an Si component and, among group 2 elements (the Group included in the periodic table defined by Recommendations 1990, IUPAC), Mg and Ba, as essential components, and a group 2 element (2A) component containing at least one element other than Mg and Ba, and a rare earth element (RE) component, wherein the ratio of the Si component content S (oxide-reduced mass %) to the sum (S+A) of S and the group 2 element (2A) component content A (oxide-reduced mass %) is 0.60 or higher" (see claim 1 of Patent Document 2).

Patent Document 3, for the purpose of improving the strength and the withstand voltage performance, discloses "an insulator . . . wherein a ratio between a content of a rare earth element as reduced to oxide and expressed in percent by mass and a content of a group 2 element (included in the periodic table defined by Recommendations 1990, IUPAC) as reduced to oxide and expressed in percent by mass, satisfies 0.1≤content of rare earth element/content of group 2 element≤1.4, and a ratio between the content of the rare earth element and a content of barium oxide as reduced to oxide and expressed in percent by mass, satisfies 0.2≤content of barium oxide/content of rare earth element≤0.8, wherein at least one virtual rectangular frame of 7.5 μm×50 μm that encloses a crystal containing the rare earth element is present in an arbitrary region of 630 μm×480 μm at a cross section of the sintered body, and an occupation ratio of an area of the crystal containing the rare earth element to an area of the rectangular frame is 5% or more, and when the rectangular frame is divided into three division regions in a direction of a long side thereof, among occupation ratios of areas of the crystal containing the rare earth element in the respective division regions, a ratio between the occupation ratio of the maximum area and the occupation ratio of the minimum area is 5.5 or less" (see claim 1 of Patent Document 3).

Patent Document 4 discloses "a ceramic material for an insulator of a spark plug, comprising: in weight percent (wt %) of said ceramic material, aluminum oxide ($Al_2O_3$) in an amount of 98.00 wt % to 99.50 wt %; at least one oxide of a Group 2 alkaline earth metal (Group 2 oxide) in an amount of 0.16 wt % to 0.70 wt %; and silicon dioxide ($SiO_2$) in an amount of 0.25 wt % to 0.75 wt %" (see claim 1 of Patent Document 4). Patent Document 4 indicates that this technique can provide a ceramic material having greater dielectric breakdown strength than prior art ceramic materials (see, for example, paragraph [0064] of Patent Document 4).

RELATED ART DOCUMENT

Patent Document 1 is Japanese Patent Application Laid-Open (kokai) No. 2001-155546.

Patent Document 2 is International Publication No. 2009/119098.

Patent Document 3 is Japanese Patent Application Laid-Open (kokai) 2014-187004.

Patent Document 4 is Japanese Patent Application Laid-Open (kokai) 2013-529355.

BRIEF SUMMARY OF THE INVENTION

In recent years, the temperature in the combustion chamber tends to be increased for high output and improved fuel efficiency of the internal combustion engine. With this, the insulator as a component of the spark plug may be exposed to a higher temperature than before, for example, about 900° C. Therefore, an insulator is desired which is able to maintain withstand voltage performance under a high temperature environment of about 900° C. In the patent documents described above, it is not assumed that the insulator is exposed to such a high temperature environment of about 900° C. Therefore, the insulators disclosed in the patent documents described above cannot achieve a sufficient level of withstand voltage performance under a high temperature environment of about 900° C.

An objective of the present invention is to provide a spark plug including an insulator capable of maintaining withstand voltage performance under a high temperature environment.

An exemplary means for solving the above problems is,

[1] A spark plug including: an insulator having an axial bore extending in a direction of an axis; a center electrode provided at a front side of the axial bore; a metallic shell provided on an outer periphery of the insulator; and a ground electrode fixed to a front end of the metallic shell, wherein the insulator contains not less than 90.0 mass % and not greater than 98.1 mass % of $Al_2O_3$ with respect to a total mass of elements, as reduced to oxides, contained in the insulator, and has a porosity A not greater than 5%, and assuming that a porosity of the insulator after the following heat treatment is B, a difference (B−A) of the porosities before and after the heat treatment is not greater than 3.5:

(Heat Treatment)

Placing the insulator in a furnace, increasing a temperature in the furnace from a room temperature to 1400° C. at a temperature increase rate of 7° C./min, holding the temperature in the furnace at 1400° C. for 30 minutes, and thereafter, decreasing the temperature in the furnace from 1400° C. to 400° C. at a temperature decrease rate of 10° C. or less per 5 minutes and then decreasing to the room temperature.

Preferable modes of the exemplary means [1] are described below.

[2] A cut surface of the insulator, which is obtained by cutting the insulator at a plane orthogonal to the axis, is analyzed by means of an electron probe micro analyzer after the heat treatment, and a ratio $RA_{Si}$ of a mass of an Si component as reduced to oxide to a total mass of all elements, as reduced to oxides, detected through the analysis is not less than 0.3 mass %.

[3] In the spark plug according to the above [1] or [2], in the insulator, a ratio of a total mass of an Na component and a K component as reduced to oxides to the total mass of the elements, as reduced to oxides, contained in the insulator is not greater than 200 ppm.

[4] In the spark plug according to any one of the above [1] to [3], the porosity A is not greater than 1.2%, and the difference (B−A) of the porosities before and after the heat treatment is not greater than 2.0%.

[5] In the spark plug according to any one of the above [2] to [4], the ratio $RA_{Si}$ (i.e., the ratio of the mass of an Si component as reduced to oxide to the total mass of all elements, as reduced to oxides, detected through the analysis) is not less than 0.8 mass %.

[6] In the spark plug according to any one of the above [1] to [5], when a cut surface of the insulator obtained by cutting the insulator at a plane orthogonal to the axis is analyzed by means of an electron probe micro analyzer, and mass ratios (mass %) of a Ba component, an Mg component, a Ca component, and an Sr component as reduced to oxides to a total mass of all elements, as reduced to oxides, detected through the analysis are represented by $R_{Ba}$, $R_{Mg}$, $R_{Ca}$, and $R_{Sr}$, respectively, the $R_{Ba}$, $R_{Mg}$, $R_{Ca}$, and $R_{Sr}$ satisfy conditions (1) to (4) as follows:

$$0.4 \le R_{Ba} \le 5.0 \quad (1)$$

$$0 \le R_{Mg} \le 0.5 \quad (2)$$

$$0 \le R_{Ca} \le 0.8 \quad (3)$$

$$0 \le R_{Sr} \le 1.5 \quad (4)$$

In other words, when a cut surface of the insulator obtained by cutting the insulator at a plane orthogonal to the axis is analyzed by means of an electron probe micro analyzer: a mass ratio of a Ba component as reduced to oxides to a total mass of all elements, as reduced to oxides, detected through the analysis is greater than or equal to 0.4 and less than or equal to 5.0; a mass ratio of an Mg component as reduced to oxides to a total mass of all elements, as reduced to oxides, detected through the analysis is less than or equal to 0.5; a mass ratio of a Ca component as reduced to oxides to a total mass of all elements, as reduced to oxides, detected through the analysis is less than or equal to 0.8; and a mass ratio of an Sr component as reduced to oxides to a total mass of all elements, as reduced to oxides, detected through the analysis is less than or equal to 1.5.

[7] In the spark plug according to any one of the above [1] to [6], when a cut surface of the insulator obtained by cutting the insulator at a plane orthogonal to the axis is analyzed by means of an electron probe micro analyzer after the heat treatment, and mass ratios (mass %) of a Ba component, an Mg component, a Ca component, and an Sr component as reduced to oxides to a total mass of all elements, as reduced to oxides, detected through the analysis are represented by $RA_{Ba}$, $RA_{Mg}$, $RA_{Ca}$, and $RA_{Sr}$, respectively, the $RA_{Ba}$, $RA_{Mg}$, $RA_{Ca}$, and $RA_{Sr}$, satisfy the conditions (11) to (14) as follows:

$$0.3 \le RA_{Ba} \le 4.9 \quad (11)$$

$$0 \le RA_{Mg} \le 0.4 \quad (12)$$

$$0 \le RA_{Ca} \le 0.7 \quad (13)$$

$$0 \le RA_{Sr} \le 1.4 \quad (14)$$

In other words, when a cut surface of the insulator, which is obtained by cutting the insulator at a plane orthogonal to the axis, is analyzed by means of an electron probe micro analyzer after the heat treatment: a mass ratio of a Ba component as reduced to oxides to a total mass of all elements, as reduced to oxides, detected through the analysis is greater than or equal to 0.3 and less than or equal to 4.9; a mass ratio of an Mg component as reduced to oxides to a total mass of all elements, as reduced to oxides, detected through the analysis is less than or equal to 0.4; a mass ratio of a Ca component as reduced to oxides to a total mass of all elements, as reduced to oxides, detected through the analysis is less than or equal to 0.7; and a mass ratio of an Sr component as reduced to oxides to a total mass of all elements, as reduced to oxides, detected through the analysis is less than or equal to 1.4.

In the spark plug according to the present invention, the insulator contains not less than 90.0 mass % and not greater than 98.1 mass % of $Al_2O_3$, the porosity A is not greater than 5%, and the difference (B−A) of the porosities in the insulator before and after the heat treatment is not greater than 3.5%. Therefore, even when the spark plug is used under a high temperature environment of, for example, 900° C., withstand voltage performance can be maintained. Therefore, according to the present invention, it is possible to provide a spark plug including an insulator capable of maintaining withstand voltage performance under a high temperature environment.

DETAILED DESCRIPTION OF EXEMPLARY EMBODIMENTS OF THE INVENTION

Figure 1:
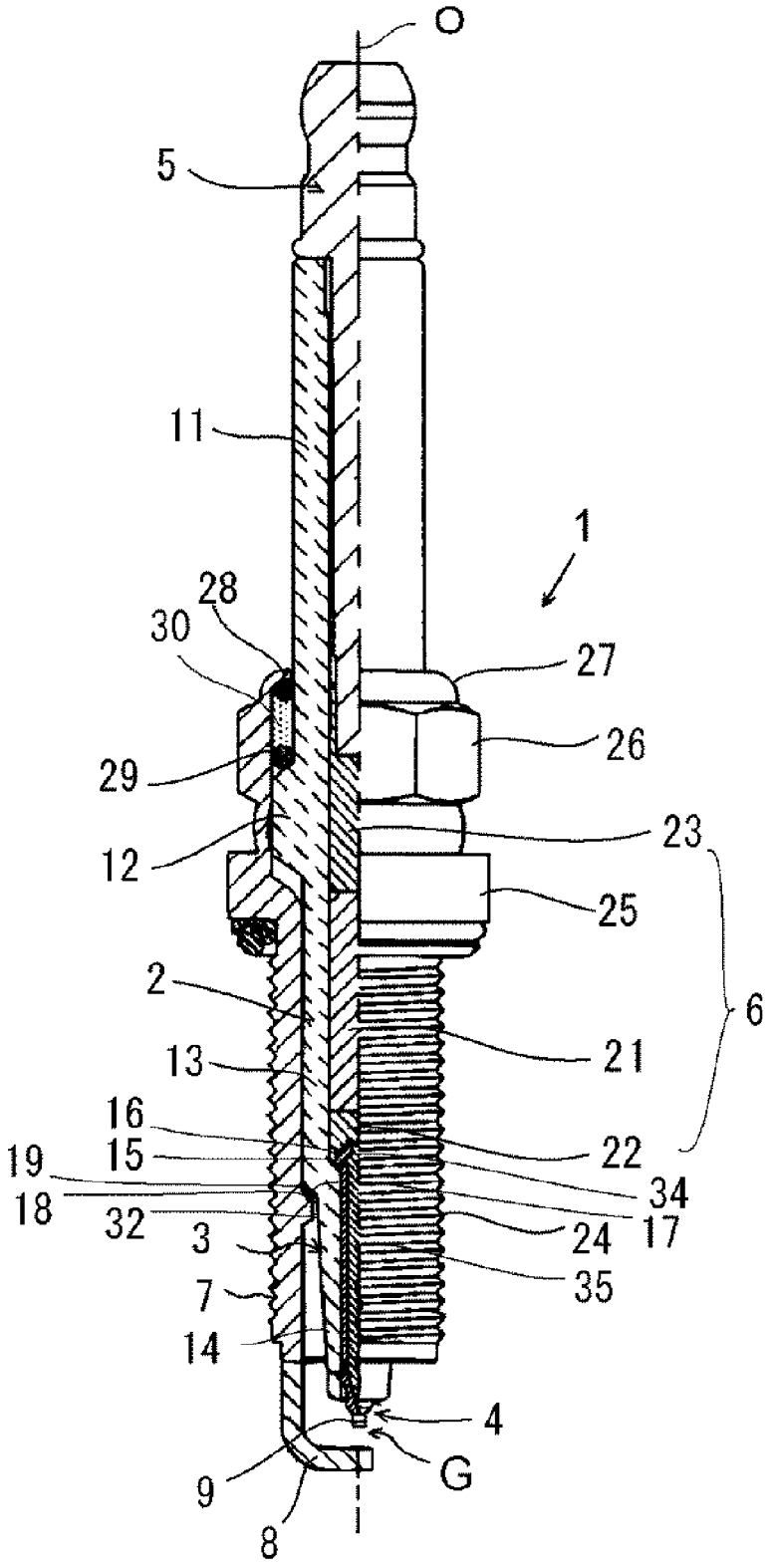
FIG. 1 is a partially sectional explanatory view of a spark plug which is one embodiment of a spark plug according to the present invention.

A spark plug which is one embodiment of a spark plug according to the present invention is shown in FIG. 1. FIG. 1 is a partially sectional explanatory view of a spark plug 1 which is one embodiment of a spark plug according to the present invention. In FIG. 1, the downward direction on the sheet, i.e., the direction toward the side at which a later-described ground electrode is disposed, is a frontward direction along an axis O, and the upward direction on the sheet is a rearward direction along the axis O.

As shown in FIG. 1, this spark plug 1 includes: a substantially cylindrical insulator 3 having an axial bore 2 that extends in the direction of the axis O; a substantially rod-shaped center electrode 4 provided at the front side in the axial bore 2; a metal terminal 5 provided at the rear side in the axial bore 2; a connection portion 6 electrically connecting the center electrode 4 and the metal terminal 5 in the axial bore 2; a substantially cylindrical metallic shell 7 provided on the outer periphery of the insulator 3; and a ground electrode 8 having a base end portion fixed to a front end of the metallic shell 7, and a front end portion opposed to the center electrode 4 via a gap G.

The insulator 3 has the axial bore 2 extending in the direction of the axis O, and has a substantially cylindrical shape. The insulator 3 includes a rear trunk portion 11, a large diameter portion 12, a front trunk portion 13, and a leg portion 14. The rear trunk portion 11 houses the metal terminal 5, and insulates the metal terminal 5 and the metallic shell 7 from each other. The large diameter portion 12 projects radially outward at the front side relative to the rear trunk portion 11. The front trunk portion 13 houses the connection portion 6 at the front side relative to the large diameter portion 12, and has an outer diameter smaller than that of the large diameter portion 12. The leg portion 14 houses the center electrode 4 at the front side relative to the front trunk portion 13, and has an outer diameter and an inner diameter smaller than those of the front trunk portion 13. Inner peripheral surfaces of the front trunk portion 13 and the leg portion 14 are connected via a ledge portion 15. A flange portion 16, described below, of the center electrode 4 is disposed so as to contact the ledge portion 15, to fix the center electrode 4 in the axial bore 2. Outer peripheral surfaces of the front trunk portion 13 and the leg portion 14 are connected via a stepped portion 17. A tapered portion 18, described below, of the metallic shell 7 contacts the stepped portion 17 through a sheet packing 19, to fix the insulator 3 to the metallic shell 7. The insulator 3 is fixed to the metallic shell 7, with an end portion, in the frontward direction, of the insulator 3 projecting from a front end face of the metallic shell 6. The insulator 3 is formed from a material having mechanical strength, thermal strength, and electrical strength. The insulator 3, which is a feature of the present invention, will be described later in detail.

In the axial bore 2 of the insulator 3, the center electrode 4 is provided on the front side, the metal terminal 5 is provided on the rear side, and the connection portion 6 is provided between the center electrode 4 and the metal terminal 5. The connection portion 6 fixes the center electrode 4 and the metal terminal 5 in the axial bore 2, and electrically connects therebetween. The connection portion 6 is formed by a resistor 21, a first seal body 22, and a second seal body 23. The resistor 21 is disposed for reducing propagation noise. The first seal body 22 is provided between the resistor 21 and the center electrode 4. The second seal body 23 is provided between the resistor 21 and the metal terminal 5. The resistor 21 is formed by sintering a composition containing glass powder, nonmetal conductive powder, metal powder, and the like, and the resistance value thereof is typically higher than or equal to 100Ω. The first seal body 22 and the second seal body 23 are each formed by sintering a composition containing glass powder, metal powder, and the like, and the resistance value thereof is typically lower than or equal to 100 mΩ. The connection portion 6 of the present embodiment is formed by the resistor 21, the first seal body 22, and the second seal body 23, but may be formed by at least one of the resistor 21, the first seal body 22, and the second seal body 23.

The metallic shell 7 has a substantially cylindrical shape, and is formed such that the metallic shell 7 holds the insulator 3 when the insulator 3 is inserted therein. The metallic shell 7 has a screw portion 24 formed on an outer peripheral surface thereof in the frontward direction. The screw portion 24 is used for mounting the spark plug 1 to a cylinder head of an internal combustion engine which is not shown. The metallic shell 7 has a flange-shaped gas seal portion 25 at the rear side of the screw portion 24, and has a tool engagement portion 26 for engaging a tool such as a spanner or a wrench at the rear side of the gas seal portion 25, and a crimping portion 27 at the rear side of the tool engagement portion 26. Ring-shaped packings 28, 29 and a talc 30 are disposed in an annular space formed between the inner peripheral surfaces of the crimping portion 27 and the tool engagement portion 26, and the outer peripheral surface of the insulator 3, and the insulator 3 is fixed relative to the metallic shell 7. The front end portion of the inner peripheral surface of the screw portion 24 is disposed so as to form a space with respect to the leg portion 14. The tapered portion 18, which is provided on the side rearward of a projection 32 projecting radially inward, and has a diameter expanded in a tapered manner, and the stepped portion 17 of the insulator 3 contact each other through the annular sheet packing 19. The metallic shell 7 may be formed from a conductive steel material such as low-carbon steel.

The metal terminal 5 is a terminal for applying a voltage from the outside to the center electrode 4 so as to cause spark discharge between the center electrode 4 and the ground electrode 8. The metal terminal 5 is inserted into the axial bore 2 and fixed by the second seal body 23, with a part thereof being exposed from the rear end side of the insulator 3. The metal terminal 5 may be formed from a metal material such as low-carbon steel.

The center electrode 4 has a rear end portion 34 in contact with the connection portion 6, and a rod-shaped portion 35 extending toward the front side from the rear end portion 34. The rear end portion 34 has the flange portion 16 that projects radially outward. The flange portion 16 is disposed so as to contact the ledge portion 15 of the insulator 3, and the first seal body 22 is filled between the inner peripheral surface of the axial bore 2 and the outer peripheral surface of the rear end portion 34, whereby the center electrode 4 is fixed in the axial bore 2 of the insulator 3, with a front end thereof projecting from the front end surface of the insulator 3, and is insulated from and held by the metallic shell 7. The rear end portion 34 and the rod-shaped portion 35 of the center electrode 4 may be formed from a known material used for the center electrode 4, such as an Ni alloy. The center electrode 4 may be formed by an outer layer formed from an Ni alloy or the like, and a core portion that is formed from a material having a higher coefficient of thermal conductivity than the Ni alloy, and formed so as to be concentrically embedded in an axial portion within the outer layer. Examples of such a material of the core portion may include Cu, a Cu alloy, Ag, an Ag alloy, and pure Ni.

The ground electrode 8 is formed into, for example, a substantially prismatic shape. Specifically, the ground electrode 8 is formed such that the base end portion is joined to the front end portion of the metallic shell 7, an intermediate portion thereof is bent in a substantially L shape, and the front end portion is opposed to the center electrode 4 with a gap G therebetween. In the present embodiment, the gap G represents the shortest distance between the front end of the center electrode 4 and the side surface of the ground electrode 8. The gap G is usually set to be 0.3 to 1.5 mm. The ground electrode 8 may be formed from a known material used for the ground electrode 8, such as an Ni alloy. Like the center electrode 4, the ground electrode 8 may have, in the axial portion, a core portion formed from a material having a higher coefficient of thermal conductivity than the Ni alloy.

Hereinafter, the insulator, which is a feature of the present invention, will be described in detail.

The insulator 3 contains not less than 90.0 mass % and not greater than 98.1 mass % of $Al_2O_3$ with respect to the total mass of elements, as reduced to oxides, contained in the insulator 3. The insulator 3 containing $Al_2O_3$(alumina) in the above content is excellent in withstand voltage performance, mechanical characteristics, and the like. When the content of $Al_2O_3$ exceeds 98.1 mass %, continuous pores are likely to be formed in the insulator 3 in the process of firing, whereby the withstand voltage performance is degraded. When the content of $Al_2O_3$ is less than 90.0 mass %, the ratio of glass phases relatively increases. Therefore, when the spark plug 1 is used under a high temperature environment of, for example, 900° C., the glass phases move and pores are likely to be formed, leading to degradation in the withstand voltage performance.

In recent engines, since spark plugs are exposed to such a high temperature environment, insulation resistance of insulators is likely to be reduced, and withstand voltage performance is likely to be degraded. The inventors of the present invention have thoroughly studied an insulator formed from an alumina sintered body containing $Al_2O_3$ as a principal component, in order to improve withstand voltage performance of the insulator under a high temperature environment. As a result, the inventors have found that degradation in the withstand voltage performance of the insulator 3 used the under high temperature environment cannot be suppressed by simply reducing porosity A of the insulator 3, and that the withstand voltage performance under the high temperature environment can be maintained when the porosity A of the insulator 3 and porosity B thereof after a heat treatment described later are within predetermined ranges.

The insulator 3 can maintain the withstand voltage performance even when it is used under a high temperature environment of, for example, 900° C., if the following conditions are satisfied. That is, the insulator 3 is formed from the alumina sintered body in which the content of $Al_2O_3$ is within the above-described range. The porosity A is not greater than 5%. When the porosity of the insulator 3 after the heat treatment described later is B, a difference (B−A) of the porosities before and after the heat treatment is not greater than 3.5%.

Heat Treatment

The insulator is placed in a furnace. The temperature in the furnace is increased from the room temperature to 1400° C. at a temperature increase rate of 7° C./min, and is held at 1400° C. for 30 minutes. Thereafter, the temperature is decreased from 1400° C. to 400° C. at a temperature decrease rate of 10° C. or less per 5 minutes, and is decreased to the room temperature.

The higher the porosity A of the insulator 3 is, the more electric field concentration is likely to occur. Therefore, the porosity A is not greater than 5%, and preferably not greater than 1.2%. When the porosity A exceeds 5%, deterioration of the insulator 3 is accelerated due to the electric field concentration. The porosity B of the insulator 3 after the heat treatment is increased as compared to the porosity A before the heat treatment. The larger the increased amount (difference (B−A)) is, the more the withstand voltage performance under the high temperature environment is likely to be degraded. Therefore, the increased amount (difference (B−A)) is not greater than 3.5%, and preferably not greater than 2.0%. The smaller the increased amount is, the more the degradation in the withstand voltage performance under the high temperature environment can be suppressed. When the difference (B−A) of the porosities before and after the heat treatment exceeds 3.5%, the withstand voltage performance under the high temperature environment is degraded.

The heat treatment and a method of measuring the porosities A and B will be specifically described. First, the spark plug 1 is cut along a plane that is orthogonal to the axis O and passes the packing 19 to expose a cut surface of the insulator 3. Then, the insulator 3 with the exposed cut surface is embedded in a thermosetting resin, and the cut surface is mirror-polished. Then, the mirror-polished surface is observed by means of a scanning electron microscope (SEM), and the contrast or the like is adjusted so as to detect only pores, and then an image of the observed surface is taken at a magnification of ×500. The taken image is binarized into pores and a portion other than the pores by means of image analysis software. Subsequently, a ratio of the area of the pores to the area of the entire image is calculated to obtain the porosity A.

Next, before performing heat treatment, the insulator 3 is heated to take the insulator 3 out of a thermoplastic resin. Then, the taken insulator 3 is placed in, for example, an electric furnace, and is subjected to heat treatment as follows. That is, in air atmosphere, the temperature in the electric furnace is increased from the room temperature (25° C.) to 1400° C. at a temperature increase rate of 7° C./min, and is held at 1400° C. for 30 minutes. Thereafter, the temperature is decreased from 1400° C. to 400° C. at a temperature decrease rate of 10° C. or less per 5 minutes, and is decreased to the room temperature.

Subsequently, the polished surface of the insulator 3 after the heat treatment is observed by means of the SEM, and the porosity B is obtained in the same manner as that for the porosity A.

The porosities A and B can be adjusted by appropriately changing: the composition of alumina powder containing alumina as a principal component, which has been prepared for forming the insulator 3; the grain size distribution of the alumina powder; the press conditions, such as press pressure, for forming a molded body of the alumina powder; the firing condition; and the like.

The insulator 3 usually contains an Si component. The Si component is present in the insulator 3 in the form of oxide, ion, or the like. Generally, the Si component melts during sintering to form a liquid phase, and therefore serves as a sintering aid which promotes densification of the alumina sintered body. After completion of sintering, the Si component forms glass phases at the grain boundaries of alumina grains, or forms crystal phases together with another element, such as Al, at the grain boundaries.

Regarding the Si component contained in the insulator 3, when the cut surface of the insulator 3 obtained by cutting the insulator 3 at the plane orthogonal to the axis O is subjected to the heat treatment and then analyzed by means of an electron probe micro analyzer (EPMA), a ratio $RA_{Si}$ of the mass of the Si component as reduced to oxide to the total mass of all elements, as reduced to oxides, detected through the analysis is preferably not less than 0.3 mass %, and more preferably not less than 0.8 mass %. The Si component in the insulator 3 may be included in the glass phases existing at the grain boundaries of the alumina grains, or may be included in the crystal phases existing at the grain boundaries of the alumina grains. It is considered that, after the heat treatment in which the insulator 3 has been held at the high temperature of 1400° C. for a predetermined time period, the Si component having been included in the crystal phases remains on the cut surface of the insulator 3. The more the Si component is included in the crystal phases in the insulator 3, the more the withstand voltage performance under the high temperature environment is excellent. Therefore, when the ratio $RA_{Si}$ is not less than 0.3 mass %, particularly not less than 0.8 mass %, it is possible to provide the spark plug 1 including the insulator 3 which is more excellent in the withstand voltage performance under the high temperature environment. When the ratio $RA_{Si}$ exceeds 3.5 mass %, more conductive passages are formed in the insulator 3, which may cause degradation in the withstand voltage performance under the high temperature environment. Therefore, the ratio $RA_{Si}$ is preferably not greater than 3.5 mass %.

It is preferable that the insulator 3 contains less Na component and less K component. Specifically, the ratio of the total mass of the Na component and the K component as reduced to oxides to the total mass of the elements, as reduced to oxides, contained in the insulator 3 is preferably not greater than 200 ppm. When the ratio of the total mass of the Na component and the K component as reduced to oxides in the insulator 3 is not greater than 200 ppm, the value of the porosity B after the heat treatment can be easily adjusted to 3.5% or less. As a result, degradation in the withstand voltage performance under the high temperature environment can be suppressed.

The contents of the Na component and the K component in the insulator 3 can be obtained through ICP atomic emission spectroscopy.

The insulator 3 usually contains components (hereinafter referred to as group 2 element components) of group 2 elements included in the periodic table defined by Recommendations 1990, IUPAC. Such group 2 element components are present in the insulator 3 in the form of oxides, ions, or the like. Each group 2 element component melts during sintering to usually form a liquid phase, and therefore serves as a sintering aid which promotes densification of the alumina sintered body. When the alumina sintered body contains the group 2 element components, the alumina sintered body is densified, whereby the withstand voltage performance and the high-temperature strength are improved. From the viewpoint of low toxicity, the group 2 element components contained in the insulator 3 are preferably a Ba component, an Mg component, a Ca component, and an Sr component. The insulator 3 preferably contains at least the Ba component among the Ba component, the Mg component, the Ca component, and the Sr component. The insulator 3 may or may not contain the components other than the Ba component, and preferably contains at least one of the Mg component, the Ca component, and the Sr component.

Regarding the group 2 element components contained in the insulator 3, when the cut surface of the insulator 3 obtained by cutting the insulator 3 at the plane orthogonal to the axis O is analyzed by means of the electron probe micro analyzer (EPMA), and the mass ratios (mass %) of the Ba component, the Mg component, the Ca component, and the Sr component as reduced to oxides to the total mass of all the elements, as reduced to oxides, detected through the analysis are represented by $R_{Ba}$, $R_{Mg}$, $R_{Ca}$, and $R_{Sr}$, respectively, the $R_{Ba}$, $R_{Mg}$, $R_{Ca}$, and $R_{Sr}$ preferably satisfy conditions (1) to (4) as follows:

$$0.4 \leq R_{Ba} \leq 5.0 \quad (1)$$

$$0 \leq R_{Mg} \leq 0.5 \quad (2)$$

$$0 \leq R_{Ca} \leq 0.8 \quad (3)$$

$$0 \leq R_{Sr} \leq 1.5 \quad (4)$$

When the conditions (1) to (4) are satisfied for the group 2 element components contained in the insulator 3, degradation in the withstand voltage performance under the high temperature environment can be further suppressed. When the upper limit values of the mass ratios of the respective components shown in the conditions (1) to (4) are exceeded, more glass phases are formed, and the withstand voltage performance under the high temperature environment may be degraded. The Ba element has the largest atomic radius among the group 2 elements, and is less likely to cause migration under a high temperature environment and at application of a high voltage. In addition, the Ba component is likely to form liquid phases during sintering, and is likely to form crystal phases after sintering. Therefore, when the insulator 3 contains a relatively large amount of the Ba component among the sintering aids, it is possible to provide the spark plug 1 including the insulator 3 having excellent withstand voltage performance. Therefore, it is preferable that the insulator 3 contains a relatively large amount of the Ba component among the group 2 element components. The atomic radius becomes smaller in order of Ba, Sr, Ca, and Mg. The larger the atomic radius of an element is, the more the element is likely to cause migration. Therefore, it is preferable that the content of the group 2 element component decreases in order of Ba, Sr, Ca, and Mg.

Regarding the group 2 element components contained in the insulator 3, when the cut surface of the insulator 3 obtained by cutting the insulator 3 at the plane orthogonal to the axis O is subjected to the heat treatment and then analyzed by means of the electron probe micro analyzer (EPMA), and the mass ratios (mass %) of the Ba component, the Mg component, the Ca component, and the Sr component as reduced to oxides to the total mass of all the elements, as reduced to oxides, detected through the analysis are represented by $RA_{Ba}$, $RA_{Mg}$, $RA_{Ca}$, and $RA_{Sr}$, respectively, the $RA_{Ba}$, $RA_{Mg}$, $RA_{Ca}$, and $RA_{Sr}$ preferably satisfy conditions (11) to (14) as follows:

$$0.3 \leq RA_{Ba} \leq 4.9 \quad (11)$$

$$0 \leq RA_{Mg} \leq 0.4 \quad (12)$$

$$0 \leq RA_{Ca} \leq 0.7 \quad (13)$$

$$0 \leq RA_{Sr} \leq 1.4 \quad (14)$$

When the conditions (11) to (14) are satisfied for the group 2 element components contained in the insulator 3 after the heat treatment, degradation in the withstand voltage performance under the high temperature environment can be further suppressed. When the conditions (1) to (4) indicating the mass ratios of the respective components contained in the insulator 3 before the heat treatment are compared with the conditions (11) to (14) indicating the mass ratios of the respective components included in the insulator 3 after the heat treatment, the upper limit values and the lower limit values are smaller in the conditions (1) to (4) before the heat treatment than in the conditions (11) to (14) after the heat treatment. This is because the glass phases having been present at the cut surface of the insulator 3 may move from the cut surface of the insulator 3 to the inside of the insulator 3 after the heat treatment has been executed in which the insulator 3 is held at a high temperature of 1400° C. for the predetermined time period. The Ba component, the Sr component, the Ca component, and the Mg component may be included in the glass phases existing at the grain boundaries of the alumina grains, or may be included in the crystal phases existing at the grain boundaries of the alumina grains. The Ba component, the Sr component, the Ca component, and the Mg component included in the crystal phases are likely to remain on the cut surface of the insulator 3 even after the heat treatment. Therefore, the Ba component, the Sr component, the Ca component, and the Mg component are preferably contained so as to satisfy the conditions (11) to (14) after the heat treatment. Also in the insulator 3 after the heat treatment, it is preferable that the content of the group 2 element component decreases in order of Ba, Sr, Ca, and Mg, as in the insulator 3 before the heat treatment.

The insulator 3 may include a rare earth element component. The rare earth element component is present in the insulator 3 in the form of oxide, ion, or the like. The rare earth element component may form glass phases together with the Si component or the like, or may form alumina crystal phases together with the Al component or the like. Examples of the rare earth element component include an Sc component, a Y component, an La component, a Ce component, a Pr component, an Nd component, a Pm component, an Sm component, an Eu component, a Gd component, a Tb component, a Dy component, an Ho component, an Er component, a Tm component, a Yb component, and an Lu component.

The insulator 3 preferably contains alumina, and at least one crystal phase other than alumina. As an example of the crystal phase other than alumina, there is celsian, for example. When the insulator 3 contains the crystal phase other than alumina, degradation in the withstand voltage performance can be further suppressed when the spark plug 1 is operated under the high temperature environment. Presence of these crystal phases can be confirmed by, for example, contrasting an X-ray diffraction chart obtained through X-ray diffraction with a JCPDS card, for example.

The alumina sintered body forming the insulator 3 contains the Al component as an essential component, and usually contains an Si component and group 2 element components. Further, the insulator 3 may contain an Na component, a K component, a rare earth element component, and other components so long as the object of the present invention is not impaired. Examples of the other components include Mn, Co, Cr, Ni, and Zn. Preferably, the total content of the other components, as reduced to oxides, is not greater than 1.0 mass % to the total mass of the elements, as reduced to oxides, contained in the insulator 3.

The spark plug 1 is manufactured as follows, for example. First, a method of manufacturing the insulator 3, which is a feature of the present invention, will be described.

First, raw material powders, that is, Al compound powder, Si compound powder, and group 2 element compound powders are mixed in a slurry. The mixing ratios of the respective powders can be set to be the same as, for example, the content ratios of the respective components in the insulator 3 formed from the alumina sintered body. This mixing is preferably performed over 8 hours or more so that the raw material powders are uniformly mixed and the sintered body obtained is highly densified.

The Al compound powder is not particularly limited as long as the compound can be converted to an Al component by firing. Usually, alumina ($Al_2O_3$) powder is adopted. Since the Al compound powder sometimes actually contains unavoidable impurities such as Na or the like, high-purity Al compound powder is desirably adopted. For example, the purity of the Al compound powder is preferably 99.5% or more. In order to obtain a densified alumina sintered body, usually, Al compound powder having an average grain size of 0.1 to 5.0 μm is preferably used. The average grain size is a value measured through a laser diffraction method using a microtrac grain size distribution measuring apparatus (MT-3000), product of Nikkiso Co., Ltd.

The Si compound powder is not particularly limited as long as the compound can be converted to an Si component by firing. Examples thereof may include various inorganic powders such as oxide (including composite oxide), hydroxide, carbonate, chloride, sulfate, nitrate and phosphate of Si. Specific examples thereof may include $SiO_2$ powder. In the case where powder other than oxide is used as the Si compound powder, the used amount thereof is figured out by mass % in terms of oxide. The purity of the Si compound powder is fundamentally the same as that of the Al compound powder.

The group 2 element compound powders are not particularly limited as long as the compounds can be converted to group 2 element components, for example, a Ba component, an Sr component, a Ca component, and an Mg component by firing. Examples thereof may include various inorganic powders such as oxide (including composite oxide), hydroxide, carbonate, chloride, sulfate, nitrate and phosphate of the group 2 elements. The group 2 element compound powders are preferably Ba compound powder, Sr compound powder, Ca compound powder, and/or Mg compound powder. Specifically, examples of the Ba compound powder include BaO powder and $BaCO_3$ powder, examples of the Sr compound powder include SrO powder and $SrCO_3$ powder, examples of the Ca compound powder include CaO powder and $CaCO_3$ powder, and examples of the Mg compound powder include MgO powder and $MgCO_3$ powder. In the case where powders other than oxide are used as the group 2 element powders, the used amount of each powder is figured out by mass % in terms of oxide. The purity of each group 2 element compound powder is fundamentally the same as that of the Al compound powder.

The raw material powders are dispersed in the solvent and are mixed in the slurry with, for example, a hydrophilic binder being blended as a binder. Examples of the solvent adopted may include water and alcohol. Examples of the hydrophilic binder may include polyvinyl alcohol, water-soluble acrylic resin, gum arabic, and dextrin. These hydrophilic binders or solvents may be used singly or in combination of two or more species. Regarding the amounts of the hydrophilic binder and the solvent to be used, assuming that the raw material powder is 100 parts by mass, the hydrophilic binder is 0.1 to 5.0 parts by mass, preferably 0.5 to 3.0 parts by mass, and water used as the solvent is 40 to 120 parts by mass, preferably 50 to 100 parts by mass.

Substantially, thus produced slurry is spray-dried through spray drying or the like and granulated so as to have the average grain size of 50 to 200 μm, preferably 70 to 150 μm. The average grain size is a value measured through a laser diffraction method (microtrac grain size distribution measuring apparatus (MT-3000), product of Nikkiso Co., Ltd.).

Subsequently, the granulated product is press-molded through, for example, rubber pressing or metal mold pressing, to yield an unfired molded body preferably having the shape and dimensions of the insulator 3. The press molding is preferably performed under a pressure of 50 to 200 MPa. When the pressure is within this range, the porosity A of the alumina sintered body to be obtained can be easily adjusted to 5% or less. The outer surface of the obtained unfired molded body is polished by means of resinoid grind stone or the like, to work the unfired molded body into a desired shape.

The unfired molded body polished and finished into the desired shape is held and fired in air atmosphere at a predetermined temperature within a range of 1450 to 1700° C., preferably a range of 1550 to 1650° C. for 1 to 8 hours, preferably 3 to 7 hours, whereby an alumina sintered body is obtained. When the firing temperature is 1450 to 1700° C., the alumina sintered body is likely to be sufficiently densified, and anomalous grain growth of the alumina component is less likely to occur, whereby withstand voltage performance and mechanical strength of the alumina sintered body can be ensured. Also, when the firing time is 1 to 8 hours, the sintered body is likely to be sufficiently densified, and anomalous grain growth of the alumina component is less likely to occur, whereby withstand voltage performance and mechanical strength of the alumina sintered body can be ensured. As a firing condition for the alumina sintered body, assuming that the maximum temperature in firing the unfired molded body is C, the temperature decrease rate when the temperature is decreased from C° C. to C-400° C. is preferably 10° C. per 5 minutes. When the temperature decrease rate is within this range, the difference (B−A) of the porosities before and after the heat treatment can be adjusted to 3.5% or less. In addition, when the temperature decrease rate is within the above range, deposition of the crystal phase other than alumina is facilitated, whereby a densified alumina sintered body can be obtained.

As described above, the insulator 3 formed from the alumina sintered body is obtained. The spark plug 1 including the insulator 3 is manufactured as follows, for example. That is, an electrode material such as an Ni alloy is worked to specific shape and dimensions to form the center electrode 4 and the ground electrode 8. Preparation and working of the electrode material may be performed sequentially. For example, a melt of an Ni alloy or the like having a desired composition is prepared by means of a vacuum melting furnace, and an ingot is prepared from the melt through vacuum casting. Then, the ingot is subjected to appropriate working processes such as hot working and wire drawing so as to have desired shape and dimensions, thereby producing the center electrode 4 and the ground electrode 8.

Subsequently, one end portion of the ground electrode 8 is joined, through electric resistance welding or the like, to the end surface of the metallic shell 7 formed through plastic working or the like to desired shape and dimensions. Then, the center electrode 4 is incorporated into the insulator 3 through a known technique. Then, the axial bore 2 is filled with a composition for forming the first seal body 22, a composition for forming the resistor 21, and a composition for forming the second seal body 23 in order, while preliminary compressing the compositions. Subsequently, the compositions are compressed and heated while the metal terminal 5 is pressed into the axial bore 2 from an end portion thereof. Thus, the compositions are sintered to form the resistor 21, the first seal body 22, and the second seal body 23. Subsequently, the insulator 3 to which the center electrode 4 and the like are fixed is assembled to the metallic shell 7 to which the ground electrode 8 is joined. Finally, a front end portion of the ground electrode 8 is bent toward the center electrode 4 such that one end of the ground electrode 8 is opposed to the front end portion of the center electrode 4, whereby the spark plug 1 is manufactured.

The spark plug 1 according to the present invention is used as an ignition plug for an internal combustion engine for an automobile, such as a gasoline engine. The spark plug 1 is fixed at a predetermined position by the screw portion 24 being screwed into a screw hole provided in a head (not shown) which defines a combustion chamber of the internal combustion engine. The spark plug 1 according to the present invention can be used for any internal combustion engine. The spark plug 1 according to the present invention has excellent withstand voltage performance even when it is used under a high temperature environment, and therefore is particularly suitable for an internal combustion engine in which the inside of a combustion chamber reaches a high temperature, for example, 900° C.

The spark plug 1 according to the present invention is not limited to the above-described embodiment, and various changes can be made as long as the purpose of the present invention can be accomplished. For example, the unfired molded body may be obtained by injection molding instead of press molding. Forming the unfired molded body by injection molding is preferable because the subsequent grinding and shaping process can be omitted.

EXAMPLES

Production of Insulator

Raw material powder was prepared by mixing alumina powder, Si compound powder, and group 2 element compound powder, and rare earth element compound powder as desired. To the raw material powder, water serving as a solvent and a hydrophilic binder were added to prepare a slurry.

The slurry thus obtained was spray-dried through a spray drying method to granulate the slurry into powder having an average grain size of about 100 μm. This powder was press-molded to form an unfired molded body as a green compact of the insulator 3. The unfired molded body was fired in air atmosphere at a firing temperature within a range of 1450 to 1700° C. for a firing time set within a range of 1 to 8 hours, and thereafter, the temperature was decreased from the maximum firing temperature C to C-400° C. at a temperature decrease rate of 10° C. or less per 5 minutes, and thereafter is decreased to the room temperature. Subsequently, a glaze was applied onto a specific site of the molded body, followed by firing for finishing, thereby obtaining an insulator formed from an alumina sintered body and having a shape shown in FIG. 1.

Measurement of Porosities A and B Before and after Heat Treatment, and Respective Components The spark plug 1 was cut along a plane that was orthogonal to the axis O and passed a front end of the packing to expose a cut surface of the insulator 3. Then, the insulator 3 with the exposed cut surface was embedded in a thermosetting resin, and the cut surface was mirror-polished. The mirror-polished surface was observed by means of a scanning electron microscope (SEM) (acceleration voltage: 20 kV, spot size: 60 μm), and the contrast or the like was adjusted so as to detect only pores, and then an image of the observed surface was taken at a magnification of ×500. Then, the taken image was binarized into pores and a portion other than the pores by means of image analysis software. Subsequently, a ratio of the area of the pores to the area of the entire image was calculated to obtain the porosity A.

Further, the polished surface was analyzed by means of an electron probe micro analyzer (EPMA), and ratios of the masses of the Al component, the Si component, the group 2 element component, and the rare earth element component as reduced to oxides to the total mass of all elements, as reduced to oxides, detected through the analysis were calculated.

In addition, a sample was taken from the insulator 3, and analyzed through ICP atomic emission spectroscopy, whereby a ratio of the total mass of an Na component and a K component as reduced to oxides to the total mass of the elements, as reduced to oxides, contained in the insulator 3 was calculated.

Before performing heat treatment, the insulator 3 was heated to take the insulator 3 out of the thermoplastic resin. Then, the taken insulator 3 was placed in an electric furnace, and was subjected to heat treatment as follows. That is, in air atmosphere, the temperature in the electric furnace was increased from the room temperature (25° C.) to 1400° C. at a temperature increase rate of 7° C./min, and was held at 1400° C. for 30 minutes. Thereafter, the temperature was decreased from 1400° C. to 400° C. at a temperature decrease rate of 10° C. or less per 5 minutes, and was decreased to the room temperature.

Subsequently, the polished surface of the insulator 3 after the heat treatment was observed by means of the SEM, and the porosity B was obtained in the same manner as that for the porosity A. In addition, the polished surface of the insulator 3 after the heat treatment was analyzed by means of the EPMA, and ratios of the masses of the Al component, the Si component, the group 2 element component, and the rare earth element component as reduced to oxides to the total mass of all the elements, as reduced to oxides, detected through the analysis were calculated.

The analysis results are shown in Table 1 and Table 2. In Table 1 and Table 2, items not subjected to the above analysis are indicated by "–". Each of insulators corresponding to test numbers 21 to 50 has a porosity A not greater than 5% and a difference (B–A) not greater than 3.5%.

Withstand Voltage Test I

Figure 2:
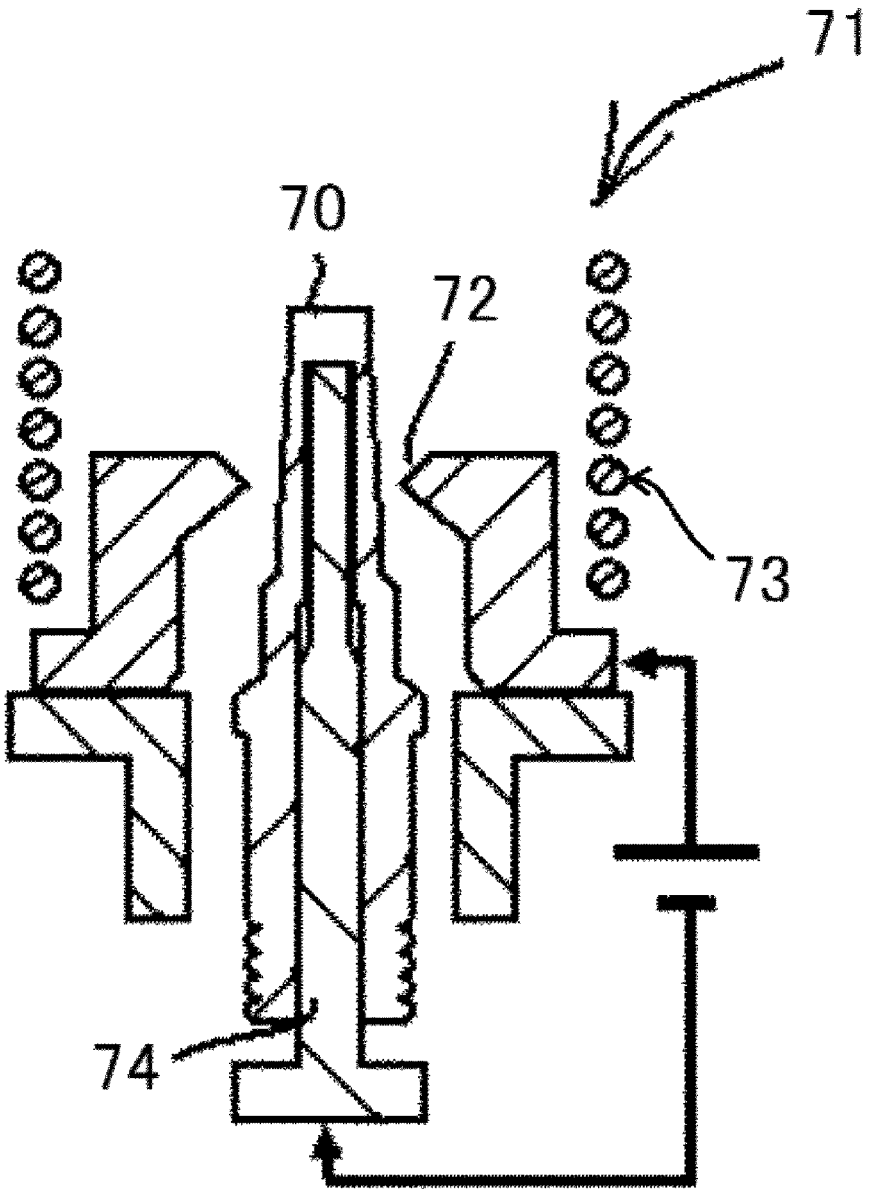
FIG. 2 is a schematic cross-sectional view showing a withstand voltage measuring apparatus used for measuring withstand voltage performance in Examples.

A withstand voltage measurement insulator 70 shown in FIG. 2 was produced by substantially the same method as (Production of insulator) described above. The withstand voltage measurement insulator 70 has an axial bore in the center thereof along the axial direction, and a front end portion of the axial bore is closed. A withstand voltage value (kV), at 900° C., of the withstand voltage measurement insulator 70 was measured by using a withstand voltage measurement apparatus 71 shown in FIG. 2. The withstand voltage measurement apparatus 71, as shown in FIG. 2, includes: a metallic annular member 72 disposed near and spaced apart from a front end portion of the withstand voltage measurement insulator 70; and a heater 73 for heating the withstand voltage measurement insulator 70. A center electrode 74 was inserted into the axial bore of the withstand voltage measurement insulator 70 to reach the front end portion of the axial bore, and the annular member 72 was disposed near the front end portion of the withstand voltage measurement insulator 70, and the withstand voltage of the withstand voltage measurement insulator 70 formed from the alumina sintered body was measured. Specifically, in the state where the front end portion of the withstand voltage measurement insulator 70 was heated to 900° C. with the heater 73 and the temperature of the annular member 72 reached 900° C., a voltage was applied between the center electrode 74 and the annular member 72, and the voltage was increased at 0.5 kV/s. A voltage value was measured when dielectric breakdown occurred in the withstand voltage measurement insulator 70, that is, when the withstand voltage measurement insulator 70 was perforated and the voltage was not further increased. Evaluation of withstand voltage performance was performed according to the following criteria, and evaluated withstand voltage performances were indicated by symbols "1" to "10" in Table 1. The results were shown in Table 1.

1: less than 14 kV
2: not less than 14 kV and less than 16 kV
3: not less than 16 kV and less than 18 kV
4: not less than 18 kV and less than 20 kV
5: not less than 20 kV and less than 22 kV
6: not less than 22 kV and less than 24 kV
7: not less than 24 kV and less than 26 kV
8: not less than 26 kV and less than 28 kV
9: not less than 28 kV and less than 30 kV
10: not less than 30 kV

TABLE 1

| Test No. | Porosity A (%) | Porosity B after heat treatment (%) | Difference (B – A) (%) | Before heat treatment | | | | | | | | | |
|---|---|---|---|---|---|---|---|---|---|---|---|---|---|
| | | | | EPMA (mass %) | | | | | | | ICP analysis (ppm) | | |
| | | | | $Al_2O_3$ | $SiO_2$ | MgO | CaO | SrO | BaO | $La_2O_3$ | $NaO_2$ | $K_2O$ | $Na_2O$ + $K_2O$ |
| 1 | 3 | 5 | 2 | 94.96 | 2.8 | 0.1 | 1.7 | 0 | 0.4 | 0 | 320 | 100 | 420 |
| 2 | 2.8 | 3.3 | 0.5 | 94.96 | 2.8 | 0.1 | 1.7 | 0 | 0.4 | 0 | — | — | — |

TABLE 1-continued

| | | | | | | | | | | | | | |
|---|---|---|---|---|---|---|---|---|---|---|---|---|---|
| 3 | 3 | 6.5 | 3.5 | 94.96 | 2.8 | 0.1 | 1.7 | 0 | 0.4 | 0 | — | — | — |
| 4 | 3 | 8 | 5 | 94.96 | 2.8 | 0.1 | 1.7 | 0 | 0.4 | 0 | — | — | — |
| 5 | 5 | 6.5 | 1.5 | 94.96 | 2.8 | 0.1 | 1.7 | 0 | 0.4 | 0 | — | — | — |
| 6 | 5.5 | 7.5 | 2 | 94.96 | 2.8 | 0.1 | 1.7 | 0 | 0.4 | 0 | — | — | — |
| 7 | 3 | 5 | 2 | 87 | 10.8 | 0.1 | 1.7 | 0 | 0.4 | 0 | — | — | — |
| 8 | 3 | 5 | 2 | 90 | 7.8 | 0.1 | 1.7 | 0 | 0.4 | 0 | — | — | — |
| 9 | 3 | 5 | 2 | 98.1 | 1.6 | 0.1 | 0.1 | 0 | 0.1 | 0 | — | — | — |
| 10 | 3 | 5 | 2 | 99 | 0.7 | 0.1 | 0.1 | 0 | 0.1 | 0 | — | — | — |
| 11 | 3 | 6.5 | 3.5 | 94.96 | 2.8 | 0.1 | 1.7 | 0 | 0.4 | 0 | 300 | 100 | 400 |
| 12 | 3 | 6.5 | 3.5 | 94.96 | 2.8 | 0.1 | 1.7 | 0 | 0.4 | 0 | 300 | 100 | 400 |
| 13 | 3 | 5 | 2 | 93.66 | 4.1 | 0.1 | 1.7 | 0 | 0.4 | 0 | 300 | 100 | 400 |
| 14 | 3 | 5 | 2 | 94.98 | 2.8 | 0.1 | 1.7 | 0 | 0.4 | 0 | 150 | 50 | 200 |
| 15 | 3 | 5 | 2 | 94.99 | 2.8 | 0.1 | 1.7 | 0 | 0.4 | 0 | 50 | 20 | 70 |
| 16 | 3 | 5.8 | 2.8 | 94.92 | 2.65 | 0.09 | 2.06 | 0 | 0.24 | 0 | 300 | 100 | 400 |
| 17 | 1.2 | 3.2 | 2 | 94.96 | 2.8 | 0.1 | 1.7 | 0 | 0.4 | 0 | 320 | 100 | 420 |

| Test | After heat treatment EPMA (mass %) | | | | | | | Evaluation result of high temperature withstand voltage |
|---|---|---|---|---|---|---|---|---|
| No. | $Al_2O_3$ | $SiO_2$ | MgO | CaO | SrO | BaO | $La_2O_3$ | performance |
| 1 | 95.82 | 2.1 | 0.08 | 1.66 | 0 | 0.34 | 0 | 7 |
| 2 | — | — | — | — | — | — | — | 7 |
| 3 | — | — | — | — | — | — | — | 7 |
| 4 | — | — | — | — | — | — | — | 1 |
| 5 | — | — | — | — | — | — | — | 6 |
| 6 | — | — | — | — | — | — | — | 1 |
| 7 | — | — | — | — | — | — | — | 1 |
| 8 | — | — | — | — | — | — | — | 6 |
| 9 | — | — | — | — | — | — | — | 6 |
| 10 | — | — | — | — | — | — | — | 1 |
| 11 | 97.82 | 0.1 | 0.08 | 1.66 | 0 | 0.34 | 0 | 6 |
| 12 | 97.62 | 0.3 | 0.08 | 1.66 | 0 | 0.34 | 0 | 7 |
| 13 | 94.42 | 3.5 | 0.08 | 1.66 | 0 | 0.34 | 0 | 8 |
| 14 | 95.82 | 2.1 | 0.08 | 1.66 | 0 | 0.34 | 0 | 9 |
| 15 | 95.82 | 2.1 | 0.08 | 1.66 | 0 | 0.34 | 0 | 9 |
| 16 | 97.12 | 0.8 | 0.08 | 1.66 | 0 | 0.34 | 0 | 8 |
| 17 | 95.82 | 2.1 | 0.08 | 1.66 | 0 | 0.34 | 0 | 10 |

As shown in Table 1, the insulators corresponding to the test Nos. 4, 6, 7, and 10, in which any of the $Al_2O_3$ content, the porosity A, and the porosity difference (B−A) is outside the scope of the present invention, are given the evaluation result of "1", and therefore are inferior in the withstand voltage performance. On the other hand, the insulators corresponding to the test Nos. 1 to 3, 5, 8, 9, and 11 to 17 are given the evaluation results of "5" to "10", and therefore are superior in the withstand voltage performance.

When the test No. 11 is compared to the test Nos. 12 to 17, the evaluation results of the test Nos. 12 to 17 are "7" to "10" while the evaluation result of the test No. 11 is "6". Thus, the insulators corresponding to the test Nos. 12 to 17 in which the ratio of $SiO_2$ after the heat treatment is 0.3 mass % or more are superior in the withstand voltage performance to the insulator corresponding to the test No. 11 in which the ratio of $SiO_2$ after the heat treatment is 0.1 mass %.

When the test No. 12 is compared to the test Nos. 13 to 17, the evaluation results of the test Nos. 13 to 17 are "8" to "10" while the evaluation result of the test No. 12 is "7". Thus, the insulators corresponding to the test Nos. 13 to 17 in which the ratio of $SiO_2$ after the heat treatment is 0.8 mass % or more are superior in the withstand voltage performance to the insulator corresponding to the test No. 12 in which the ratio of $SiO_2$ after the heat treatment is 0.3 mass %.

When the test Nos. 14 and 15 are compared with the test Nos. 11 to 13 and 16, the evaluation results of the test Nos. 11 to 13 and 16 are "6" to "8" while the evaluation results of the test Nos. 14 and 15 are "9". Thus, the insulators corresponding to the test Nos. 14 and 15 in which the ratio of the Na component and the K component is 200 ppm or less are superior in the withstand voltage performance to the insulators corresponding to the test Nos. 11 to 13 and 16 in which the ratio of the Na component and the K component is 400 ppm.

Withstand Voltage Test II

In advance of the withstand voltage test I, a withstand voltage test II was performed in a similar manner to the withstand voltage test I except that a voltage of 10 kV at a DC power supply was applied between the center electrode 74 and the annular member 72 for 5 minutes in the state where the temperature of the annular member 72 reached 900° C. Evaluation of withstand voltage performance was performed according to the following criteria, and evaluated withstand voltage performances were indicated in Table 2 by symbols "1" to "10". The results are shown in Table 2.

1: less than 14 kV

2: not less than 14 kV and less than 16 kV

3: not less than 16 kV and less than 18 kV

4: not less than 18 kV and less than 20 kV

5: not less than 20 kV and less than 22 kV

6: not less than 22 kV and less than 24 kV

7: not less than 24 kV and less than 26 kV

8: not less than 26 kV and less than 28 kV

9: not less than 28 kV and less than 30 kV

10: not less than 30 kV

TABLE 2

| Test | Before heat treatment EPMA (mass %) | | | | | | | After heat treatment EPMA (mass %) | | | | | | | Evaluation result of high temperature withstand voltage |
|---|---|---|---|---|---|---|---|---|---|---|---|---|---|---|---|
| No. | $Al_2O_3$ | $SiO_2$ | MgO | CaO | SrO | BaO | $La_2O_3$ | $Al_2O_3$ | $SiO_2$ | MgO | CaO | SrO | BaO | $La_2O_3$ | performance |
| 21 | 95.5 | 2.8 | 0.2 | 0.5 | 0.0 | 1.0 | 0.0 | — | — | — | — | — | — | — | 10 |
| 22 | 94.9 | 2.8 | 0.2 | 1.7 | 0.0 | 0.4 | 0.0 | — | — | — | — | — | — | — | 7 |
| 23 | 93.3 | 2.8 | 0.2 | 1.7 | 0.0 | 2.0 | 0.0 | — | — | — | — | — | — | — | 8 |
| 24 | 95.2 | 2.8 | 0.2 | 1.7 | 0.0 | 0.1 | 0.0 | — | — | — | — | — | — | — | 1 |
| 25 | 90.8 | 2.5 | 0.2 | 1.5 | 0.0 | 5.0 | 0.0 | — | — | — | — | — | — | — | 5 |
| 26 | 91.0 | 2.2 | 0.2 | 1.5 | 0.0 | 5.1 | 0.0 | — | — | — | — | — | — | — | 1 |
| 27 | 95.1 | 2.8 | 0.0 | 1.7 | 0.0 | 0.4 | 0.0 | — | — | — | — | — | — | — | 8 |
| 28 | 94.6 | 2.8 | 0.5 | 1.7 | 0.0 | 0.4 | 0.0 | — | — | — | — | — | — | — | 7 |
| 29 | 94.1 | 2.8 | 1.0 | 1.7 | 0.0 | 0.4 | 0.0 | — | — | — | — | — | — | — | 1 |
| 30 | 95.3 | 2.8 | 1.5 | 0.0 | 0.0 | 0.4 | 0.0 | — | — | — | — | — | — | — | 8 |
| 31 | 95.8 | 2.8 | 0.2 | 0.8 | 0.0 | 0.4 | 0.0 | — | — | — | — | — | — | — | 8 |
| 32 | 95.6 | 2.8 | 0.2 | 1.0 | 0.0 | 0.4 | 0.0 | — | — | — | — | — | — | — | 1 |
| 33 | 94.9 | 2.8 | 0.2 | 1.7 | 0.0 | 0.4 | 0.0 | — | — | — | — | — | — | — | 8 |
| 34 | 93.4 | 2.8 | 0.2 | 1.7 | 1.5 | 0.4 | 0.0 | — | — | — | — | — | — | — | 7 |
| 35 | 92.9 | 2.8 | 0.2 | 1.7 | 2.0 | 0.4 | 0.0 | — | — | — | — | — | — | — | 1 |
| 36 | 93.5 | 2.8 | 0.2 | 0.5 | 0.0 | 1.0 | 2.0 | — | — | — | — | — | — | — | 10 |
| 37 | 91.3 | 2.8 | 0.2 | 1.7 | 0.0 | 2.0 | 2.0 | — | — | — | — | — | — | — | 8 |
| 38 | 94.9 | 2.8 | 0.2 | 1.7 | 0.0 | 0.4 | 0.0 | 93.9 | 2.5 | 0.2 | 1.5 | 0.0 | 0.2 | 1.7 | 3 |
| 39 | 94.7 | 2.8 | 0.2 | 1.7 | 0.0 | 0.6 | 0.0 | 93.9 | 2.2 | 0.2 | 1.5 | 0.0 | 0.5 | 1.7 | 8 |
| 40 | 90.8 | 2.5 | 0.2 | 1.5 | 0.0 | 5.0 | 0.0 | 89.5 | 2.2 | 0.2 | 1.5 | 0.0 | 4.9 | 1.7 | 5 |
| 41 | 91.0 | 2.2 | 0.2 | 1.5 | 0.0 | 5.1 | 0.0 | 89.4 | 2.2 | 0.2 | 1.5 | 0.0 | 5.0 | 1.7 | 1 |
| 42 | 95.1 | 2.8 | 0.0 | 1.7 | 0.0 | 0.4 | 0.0 | 94.2 | 2.3 | 0.0 | 1.5 | 0.0 | 0.3 | 1.7 | 8 |
| 43 | 94.6 | 2.8 | 0.5 | 1.7 | 0.0 | 0.4 | 0.0 | 93.8 | 2.3 | 0.4 | 1.5 | 0.0 | 0.3 | 1.7 | 7 |
| 44 | 94.1 | 2.8 | 1.0 | 1.7 | 0.0 | 0.4 | 0.0 | 93.4 | 2.3 | 0.8 | 1.5 | 0.0 | 0.3 | 1.7 | 1 |
| 45 | 96.6 | 2.8 | 0.2 | 0.0 | 0.0 | 0.4 | 0.0 | 94.2 | 2.3 | 1.5 | 0.0 | 0.0 | 0.3 | 1.7 | 8 |
| 46 | 95.8 | 2.8 | 0.2 | 0.8 | 0.0 | 0.4 | 0.0 | 94.9 | 2.3 | 0.1 | 0.7 | 0.0 | 0.3 | 1.7 | 8 |
| 47 | 95.6 | 2.8 | 0.2 | 1.0 | 0.0 | 0.4 | 0.0 | 94.7 | 2.3 | 0.1 | 0.9 | 0.0 | 0.3 | 1.7 | 1 |
| 48 | 94.9 | 2.8 | 0.2 | 1.7 | 0.0 | 0.4 | 0.0 | 94.0 | 2.3 | 0.2 | 1.5 | 0.0 | 0.3 | 1.7 | 8 |
| 49 | 93.4 | 2.8 | 0.2 | 1.7 | 1.5 | 0.4 | 0.0 | 92.6 | 2.3 | 0.2 | 1.5 | 1.4 | 0.3 | 1.7 | 7 |
| 50 | 92.9 | 2.8 | 0.2 | 1.7 | 2.0 | 0.4 | 0.0 | 92.2 | 2.3 | 0.2 | 1.5 | 1.8 | 0.3 | 1.7 | 1 |

As shown in Table 2, when the test Nos. 22, 23, and 25 are compared to the test Nos. 24 and 26, the evaluation results of the test Nos. 24 and 26 are "1" while the evaluation results of the test Nos. 22, 23, and 25 are "7", "8", and "5", respectively. Thus, the insulators corresponding to the test Nos. 22, 23, and 25 in which the mass ratio $R_{Ba}$ of BaO is 0.4 to 5.0 mass % are superior in the withstand voltage performance to the insulators corresponding to the test Nos. 24 and 26 in which the mass ratios $R_{Ba}$ of BaO are 0.1 mass % and 5.1 mass %, respectively.

When the test Nos. 27 and 28 are compared to the test No. 29, the evaluation result of the test No. 29 is "1" while the evaluation results of the test Nos. 27 and 28 are "8" and "7", respectively. Thus, the insulators corresponding to the test Nos. 27 and 28 in which the mass ratio $R_{Mg}$ of MgO is 0 to 0.5 mass % is superior in the withstand voltage performance to the insulator corresponding to the test No. 29 in which the mass ratio $R_{Mg}$ of MgO is 1.0 mass %.

When the test Nos. 30 and 31 are compared to the test No. 32, the evaluation result of the test No. 32 is "1" while the evaluation results of the test Nos. 30 and 31 are "8". Thus, the insulators corresponding to the test Nos. 30 and 31 in which the mass ratio $R_{Ca}$ of CaO is 0 to 0.8 mass % are superior in the withstand voltage performance to the insulator corresponding to the test No. 32 in which the mass ratio $R_{Ca}$ of CaO is 1.0 mass %.

When the test Nos. 33 and 34 are compared to the test No. 35, the evaluation result of the test No. 35 is "1" while the evaluation results of the test Nos. 33 and 34 are "8" and "7", respectively. Thus, the insulators corresponding to the test Nos. 33 and 34 in which the mass ratio $R_{Sr}$ of SrO is 0 to 1.5 mass % is superior in the withstand voltage performance to the insulator corresponding to the test No. 35 in which the mass ratio $R_{Sr}$ of SrO is 2.0 mass %.

When the test No. 21 is compared to the test No. 36, the evaluation results of the test Nos. 21 and 36 are "10". When the test No. 23 is compared to the test No. 37, the evaluation results of the test Nos. 23 and 37 are "8". Thus, the withstand voltage performance does not vary depending on presence/absence of the rare earth element component, and the insulators corresponding to these test numbers are superior in the withstand voltage performance.

When the test Nos. 39 and 40 are compared to the test Nos. 38 and 41, the evaluation results of the test Nos. 38 and 41 are "3" and "1", respectively, while the evaluation results of the test Nos. 39 and 40 are "8" and "5", respectively. Thus, the insulators corresponding to the test Nos. 39 and 40 in which the mass ratio $RA_{Ba}$ of BaO after the heat treatment is 0.3 to 4.9 mass % are superior in the withstand voltage performance to the insulators corresponding to the test Nos. 38 and 41 in which the mass ratios $RA_{Ba}$ of BaO are 0.2 mass % and 5.0 mass %, respectively.

When the test Nos. 42 and 43 are compared to the test No. 44, the evaluation result of the test No. 44 is "1" while the evaluation results of the test Nos. 42 and 43 are "8" and "7", respectively. Thus, the insulators corresponding to the test Nos. 42 and 43 in which the mass ratio $RA_{Mg}$ of MgO after the heat treatment is 0 to 0.4 mass % are superior in the withstand voltage performance to the insulator corresponding to the test No. 44 in which the mass ratio $RA_{Mg}$ of MgO is 0.8 mass %.

When the test Nos. 45 and 46 are compared to the test No. 47, the evaluation result of the test No. 47 is "1" while the evaluation results of the test Nos. 45 and 46 are "8". Thus, the insulators corresponding to the test Nos. 45 and 46 in which the mass ratio $RA_{Ca}$ of CaO after the heat treatment is 0 to 0.7 mass % are superior in the withstand voltage performance to the insulator corresponding to the test No. 47 in which the mass ratio $RA_{Ca}$ of CaO is 0.9 mass %.

When the test Nos. 48 and 49 are compared to the test No. 50, the evaluation result of the test No. 50 is "1" while the evaluation results of the test Nos. 48 and 49 are "8" and "7", respectively. Thus, the insulators corresponding to the test Nos. 48 and 49 in which the mass ratio $RA_{Sr}$ of SrO after the heat treatment is 0 to 1.4 mass % are superior in the withstand voltage performance to the insulator corresponding to the test No. 50 in which the mass ratio $RA_{Sr}$ of SrO is 1.8 mass %.

DESCRIPTION OF REFERENCE NUMERALS

1 spark plug
2 axial bore
3 insulator
4 center electrode
5 metal terminal
6 connection portion
7 metallic shell
8 ground electrode
9 tip
11 rear trunk portion
12 large diameter portion
13 front trunk portion
14 leg portion
15 ledge portion
16 flange portion
17 stepped portion
18 tapered portion
19 sheet packing
21 resistor
22 first seal body
23 second seal body
24 screw portion
25 gas seal portion
26 tool engagement portion
27 crimping portion
28, 29 packing
30 talc
32 projection
34 rear end portion
35 rod-shaped portion
70 withstand voltage measurement insulator
71 withstand voltage measurement apparatus
72 annular member
73 heater
74 center electrode
G spark discharge gap

What is claimed is:

1. A spark plug comprising:

an insulator having an axial bore extending in a direction of an axis;

a center electrode provided at a front side of the axial bore;

a metallic shell provided on an outer periphery of the insulator; and a ground electrode fixed to a front end of the metallic shell, wherein the insulator contains not less than 90.0 mass % and not greater than 98.1 mass % of $Al_2O_3$ with respect to a total mass of elements, as reduced to oxides, contained in the insulator, at least 20 ppm of a K component, and has a porosity A not greater than 5%, and assuming that a porosity of the insulator after the following heat treatment is B, a difference (B−A) of the porosities before and after the heat treatment is not greater than 3.5%:

(Heat treatment)

Placing the insulator in a furnace, increasing a temperature in the furnace from a room temperature to 1400° C. at a temperature increase rate of 7° C./min, holding the temperature in the furnace at 1400° C. for 30 minutes, and thereafter, decreasing the temperature in the furnace from 1400° C. to 400° C. at a temperature decrease rate of 10° C. or less per 5 minutes and then decreasing to the room temperature.

2. The spark plug according to claim 1, wherein a cut surface of the insulator, which is obtained by cutting the insulator at a plane orthogonal to the axis, is subjected to an analysis by means of an electron probe micro analyzer after the heat treatment, and a ratio of a mass of an Si component as reduced to oxide to the total mass of all elements, as reduced to oxides, detected through the analysis is not less than 0.3 mass %.

3. The spark plug according to claim 1, wherein, in the insulator, a ratio of a total mass of an Na component and a K component as reduced to oxides to the total mass of the elements, as reduced to oxides, contained in the insulator is not greater than 200 ppm.

4. The spark plug according to claim 1, wherein the porosity A is not greater than 1.2%, and the difference (B−A) of the porosities before and after the heat treatment is not greater than 2.0%.

5. The spark plug according to claim 2, wherein the ratio of the mass of the Si component as reduced to oxide to the total mass of all elements, as reduced to oxides, detected through the analysis is not less than 0.8 mass %.

6. The spark plug according to claim 1, wherein when a cut surface of the insulator obtained by cutting the insulator at a plane orthogonal to the axis is subjected to an analysis by means of an electron probe micro analyzer:

a mass ratio of a Ba component as reduced to oxides to the total mass of all elements, as reduced to oxides, detected through the analysis is greater than or equal to 0.4 and less than or equal to 5.0;

a mass ratio of an Mg component as reduced to oxides to the total mass of all elements, as reduced to oxides, detected through the analysis is less than or equal to 0.5;

a mass ratio of a Ca component as reduced to oxides to the total mass of all elements, as reduced to oxides, detected through the analysis is less than or equal to 0.8; and a mass ratio of an Sr component as reduced to oxides to the total mass of all elements, as reduced to oxides, detected through the analysis is less than or equal to 1.5.

7. A spark plug according to claim 1, wherein when a cut surface of the insulator, which is obtained by cutting the insulator at a plane orthogonal to the axis, is subjected to an analysis by means of an electron probe micro analyzer after the heat treatment:

a mass ratio of a Ba component as reduced to oxides to the total mass of all elements, as reduced to oxides, detected through the analysis is greater than or equal to 0.3 and less than or equal to 4.9;

a mass ratio of an Mg component as reduced to oxides to the total mass of all elements, as reduced to oxides, detected through the analysis is less than or equal to 0.4;

a mass ratio of a Ca component as reduced to oxides to the total mass of all elements, as reduced to oxides, detected through the analysis is less than or equal to 0.7; and a mass ratio of an Sr component as reduced to oxides to the total mass of all elements, as reduced to oxides, detected through the analysis is less than or equal to 1.4.

* * * * *